US005913903A

United States Patent [19]

Matsuda et al.

[11] Patent Number: 5,913,903

[45] Date of Patent: Jun. 22, 1999

[54] METHOD AND APPARATUS FOR MANUFACTURING KNIT SLIDE FASTENER STRINGER

[75] Inventors: Yoshio Matsuda; Hidenobu Kato; Yoshito Ikeguchi; Michio Ito, all of Toyama-ken, Japan

[73] Assignee: YKK Corporation, Tokyo, Japan

[21] Appl. No.: 08/907,078

[22] Filed: Aug. 6, 1997

[30] Foreign Application Priority Data

Aug. 8, 1996 [JP] Japan ..... 8-210205

[51] Int. Cl.[6] ..... D04B 23/14

[52] U.S. Cl. ..... 66/85 R; 66/83; 66/190; 66/193

[58] Field of Search ..... 66/85 R, 95, 96 R, 66/193, 203, 204, 82 R, 83, 84 R, 190, 191, 192

[56] References Cited

U.S. PATENT DOCUMENTS

| | | | |
|---|---|---|---|
| 3,653,230 | 4/1972 | Tosco | 66/85 R |
| 4,034,579 | 7/1977 | Tillon | 66/85 R |
| 5,452,591 | 9/1995 | King | 66/85 R |
| 5,653,127 | 8/1997 | Berger et al. | 66/85 R |
| 5,680,777 | 10/1997 | Zorini | 66/85 R |

FOREIGN PATENT DOCUMENTS

| | | |
|---|---|---|
| 0 385 100 | 9/1990 | European Pat. Off. . |
| 2 188 976 | 1/1974 | France . |
| 30 26 488 A1 | 2/1982 | Germany . |

*Primary Examiner*—John J. Calvert
*Assistant Examiner*—Larry D. Worrell, Jr.
*Attorney, Agent, or Firm*—Hill & Simpson

[57] ABSTRACT

A necessary number of knitting needles are slid at a predetermined timing along a multiplicity of parallel sliding grooves of a single needle bed, and a predetermined number of knitting yarn guides take lapping movements to form desired stitches of the knitting yarns while a monofilament bending means between one end of the needle bed and the yarn guides is operated at a predetermined timing for reciprocating along a predetermined number of knitting yarns at an underlapping position. During this reciprocating movement, a head-portion-holding member is moved between a holding position for holding a head portion of each fastener element from an inside thereof and a non-holding position, in synchronism with the bending of a monofilament. As a result, individual fastener elements are continuously formed by bending the monofilament, which is at the same time knitted in a warp-knit fastener tape simultaneously with the knitting of the tape, so that it is possible to efficiently manufacture a woven slide fastener stringer stable in shape.

12 Claims, 8 Drawing Sheets

METHOD AND APPARATUS FOR MANUFACTURING KNIT SLIDE FASTENER STRINGER

BACKGROUND OF THE INVENTION

1. Field of the Invention

This invention relates to a method of and an apparatus for manufacturing a knit slide fastener stringer having a fastener element row which is continuously formed by bending a linear monofilament and is knitted in and along one longitudinal edge of a warp-knit fastener tape simultaneously with the knitting of the tape. More particularly, this invention relates to a method of and an apparatus for manufacturing a knit slide fastener stringer in which a warp-knit fastener tape has a longitudinal edge of high density so that a fastener element row can be knitted in the longitudinal edge stably and firmly, and in which an increased rate of production can be realized.

2. Description of the Related Art

Knit slide fastener stringers of this type in which a coiled fastener element row is knitted in a warp-knit fastener tape simultaneously with the knitting of the tape are already known from, for example, Japanese Patent Laid-Open Publication No. Hei 2-255104 and Italian Patent No. 1118020. Further, an apparatus for manufacturing this type of knit slide fastener stringers are disclosed in, for example, the above-mentioned Italian Patent, Japanese Patent Publication No. Sho 48-40034 and Japanese Patent Publication No. Sho 49-42011.

As is described in the above-mentioned publications, in the fundamental structure of this type knit slide fastener stringer, a fastener tape including a fastener-element-row attaching margin is composed of chain-stitches, tricot-stitches and weft-inlaid stitches, and the fastener element row is knitted in and along the fastener-element-row attaching margin of the fastener tape simultaneously with the knitting of the tape in such a manner that each and every leg portion of the individual fastener element is connected with stitches of the foundation structure of the fastener-element-row attaching margin astride of part of loops of anchoring chain-stitch yarns simultaneously with the knitting of the tape. Thus the fastener element row is firmly secured to the foundation structure of the attaching margin of the tape. The anchoring yarns for the fastener elements should by no means be limited to chain stitch yarns, but may be an alternative form such as a combination of tricot-stitch yarns and weft-inlaid yarns, or etc.

In the conventional apparatus as disclosed in the above-mentioned publications, the monofilament is bent in a coiled form so as to be a coiled fastener element row before introduced into the apparatus, whereupon the fastener element row is introduced continuously to a knitting position of the attaching margin of the tape via a tubular guide member (i.e., a fastener element guide) of the apparatus and is knitted in a predetermined position of the attaching margin of the tape simultaneously with the knitting of the tape.

However, since it is formed of a coiled synthetic resin monofilament, the fastener element row is extremely extendible and contractible and hence non-stable in shape. It is therefore very difficult, from a technical viewpoint, to introduce the individual fastener elements of the fastener element row successively and accurately to the corresponding knitting portions of the fastener-element attaching margin of the tape. Further, as is apparent from the above-mentioned publications, since the conventional apparatus is not equipped with any fastener-element positioning means, it is also difficult to fixedly attach the fastener element row with head portions of the elements arranged in a uniform pitch and kept in an uniform shape. For these reasons, knit slide fasteners of this type have not been on the market in general.

SUMMARY OF THE INVENTION

With the foregoing problems in view, it is an object of this invention to provide a method of and an apparatus for efficiently manufacturing a knit slide fastener stringer in which individual fastener elements are stable in shape.

According to a first aspect of the invention, the above-mentioned object is accomplished by a method of manufacturing a knit slide fastener stringer having a fastener element row which is continuously knitted in and along one longitudinal edge of a warp-knit fastener tape simultaneously with the knitting of the fastener tape while the fastener element row is formed by bending a linear synthetic resin monofilament, said method comprising the steps of: sliding a predetermined number of knitting needles along a multiplicity of parallel sliding grooves in a single needle bed at a predetermined timing; swinging and shogging a number of knitting yarn guides in timed relation with said sliding of said knitting needles to form desired stitches; and driving monofilament bending means, which is disposed between said needle bed and said knitting yarn guides at a position near one end of said needle bed, in synchronism with the movement of said knitting needles and said knitting yarn guides, wherein said monofilament bending means reciprocates along a predetermined number of said knitting needles at an underlapping position to continuously form individual fastener elements by bending the monofilament and also to knit the fastener elements in the fastener tape simultaneously with the knitting of the fastener tape.

It is preferable that a single reciprocating movement of said monofilament bending means takes place immediately after the stitches of the fastener tape are formed, more preferably immediately after the stitches of the fastener tape are formed for each of every other courses. As an additional step, a head-portion-holding member preferably reciprocates between a holding position for holding a head portion of each fastener element and a non-head-portion-holding position in synchronism with the bending of the monofilament; in this case, since a folded portion of the monofilament as a head portion is reliably held on its inner side to form an accurate fastener element row, it is possible to knit the head portion in the fastener-element attaching margin of the tape in a uniform posture and at a certain position so that the resulting slide fastener can be closed and opened precisely.

If said head-portion-holding position is set to be disposed at an outer end portion of said needle bed, a terminal position, where said monofilament bending means is retracted so as not to interfere with the knitting yarns, of said single reciprocating movement of said monofilament bending means is disposed at a position inside the end of said needle bed. Therefore the head-portion-holding member can be kept from interference with the knitting yarns and other members to realize a stable knitting action. In this case, it is possible to obtain an ordinary type slide fastener stringer. Alternatively, if the head-portion-holding position is disposed at a position inside one end of said needle bed, a terminal position of said reciprocating movement of said monofilament bending means is disposed at an outer end portion of said needle bed. Therefore the individual head portions of the fastener elements can be formed along the inner edge of the fastener-element attaching margin of the fastener tape and, while the individual connecting portions of the elements are formed along the outer edge of the fastener-element attaching margin of the tape. Then by folding the fastener tape of the resulting stringer along the head portions, it is possible to obtain a concealed slide fastener stringer.

According to a second aspect of the invention, the foregoing method is carried out by an apparatus for manufacturing a knit slide fastener stringer having a fastener element row which is continuously knitted in and along one longitudinal edge of a warp-knit fastener tape simultaneously with the knitting of the warp-knit fastener tape while the fastener element row is formed by bending a linear synthetic resin monofilament, said apparatus comprising: a single needle bed for slidably guiding a multiplicity of parallel knitting needles: a number of knitting yarn guides adapted to be swung and shogged; monofilament bending means disposed between said needle bed and said knitting yarn guides at a position near one end of said needle bed; and driving means for synchronously driving said knitting needles and said monofilament bending means at a predetermined timing, wherein said monofilament bending means reciprocates between a predetermined number of said knitting needles at an underlapping position to continuously form individual fastener elements by bending the monofilament and also to knit the fastener elements in the fastener tape simultaneously with the knitting of the fastener tape.

Preferably, the apparatus further includes a head-portion-holding member adapted to be moved between a holding position for holding a head portion of each fastener element and a non-holding position in synchronism with the bending of the monofilament. Since the head portion is held in a fixed position from the inner side while the monofilament is bent, it is possible to knit the individual head portion at a predetermined position in a uniform pitch and in a stable posture.

For manufacturing an ordinary type slide fastener stringer, preferably said head-portion-holding member is disposed at an outer end portion of said needle bed and, at the same, a terminal position, where said monofilament bending means is retracted so as not to interfere with the knitting yarns, of said single reciprocating movement of said monofilament bending means is disposed at a position inside one end of said needle bed where the connecting portions of the fastener elements are formed. Thus, the monofilament bending means does not interfere with the knitting yarns at the terminal position of the reciprocating movement. Alternatively, for manufacturing a concealed type slide fastener stringer, said head-portion-holding member is disposed at a position inside the end of said needle bed in such a manner as to form individual connecting portions at an outer end portion of the needle bed. The movement of the needles may be either horizontal or vertical.

DETAILED DESCRIPTION OF THE PREFERRED EMBODIMENTS

Various embodiments of a knit slide fastener stringer manufacturing apparatus of this invention will now be described in detail with reference to the accompanying drawings.

Figure 1:
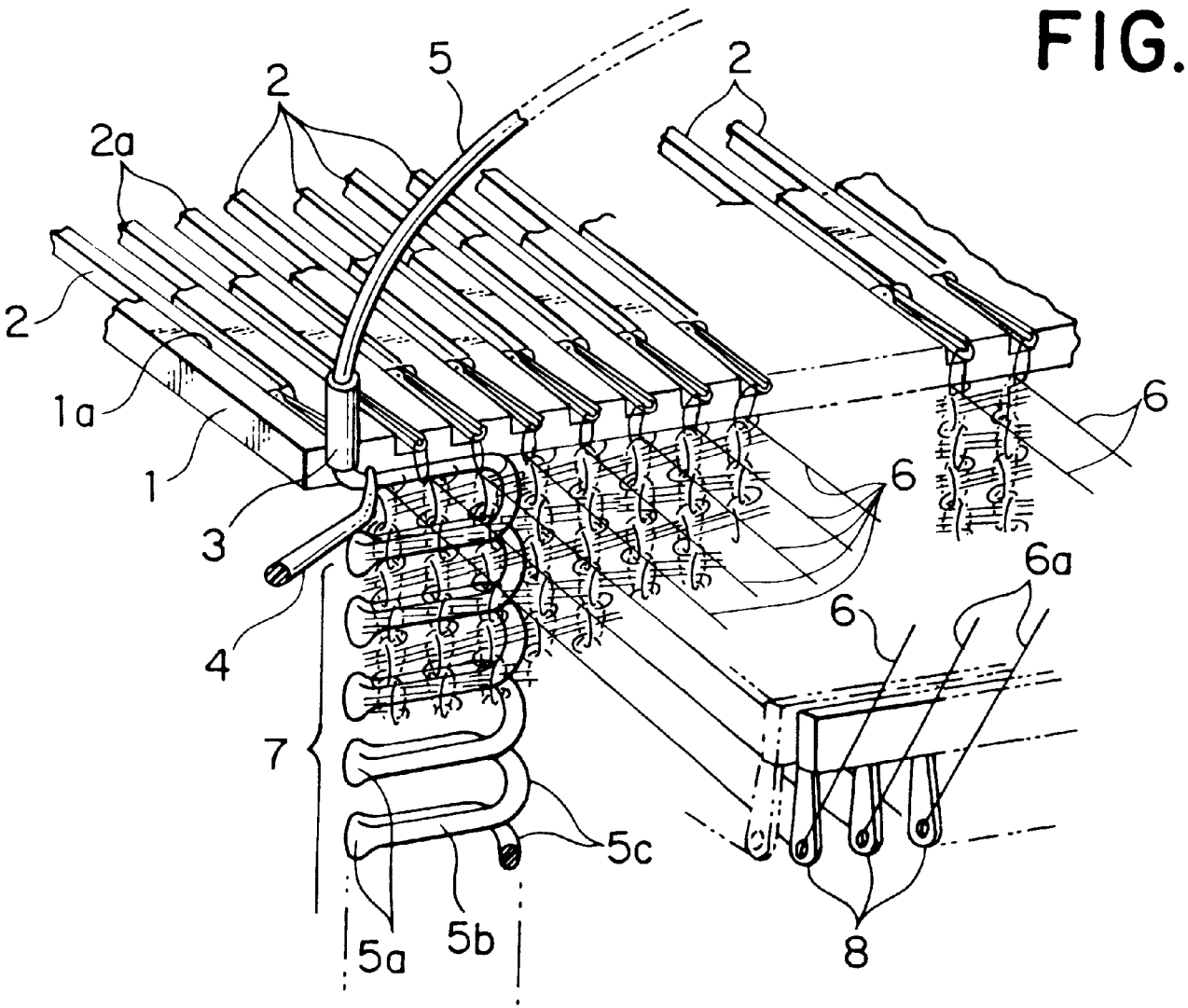
FIG. 1 shows various members of a knit slide fastener stringer manufacturing apparatus during bending of a monofilament according to a first embodiment of this invention.
Figure 2:
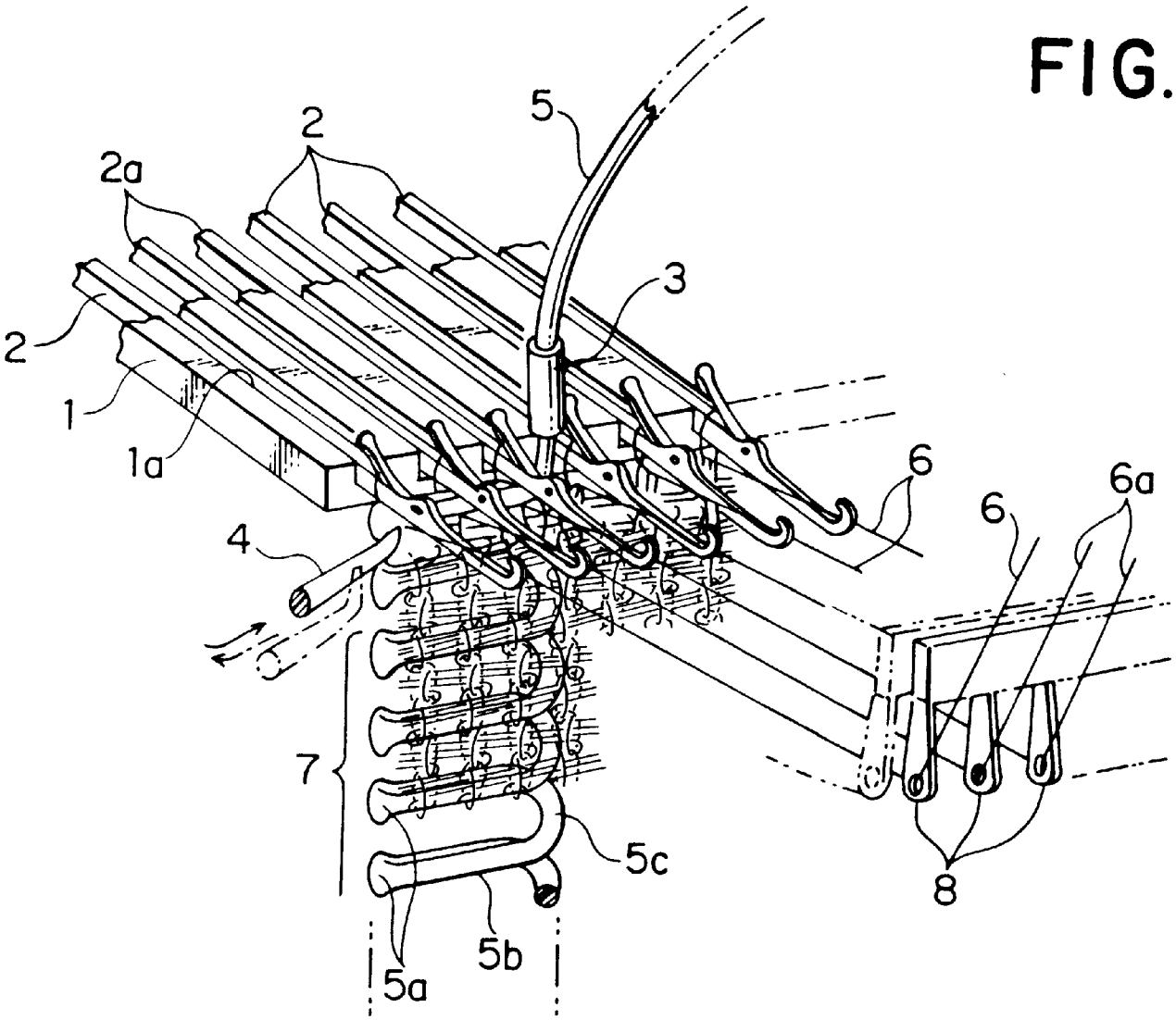
FIG. 2 shows the members of the apparatus of the first embodiment during overlapping of knitting yarns.

FIGS. 1 and 2 are perspective views showing various principal members of a knit slide fastener stringer manufacturing apparatus according to a first embodiment of the invention. In this embodiment, the apparatus is an ordinary horizontal-bed-type knitting machine, such as a single Raschel knitting machine, a crochet knitting machine or a tricot knitting machine. Consequently many details of the apparatus are not shown.

Figure 3:
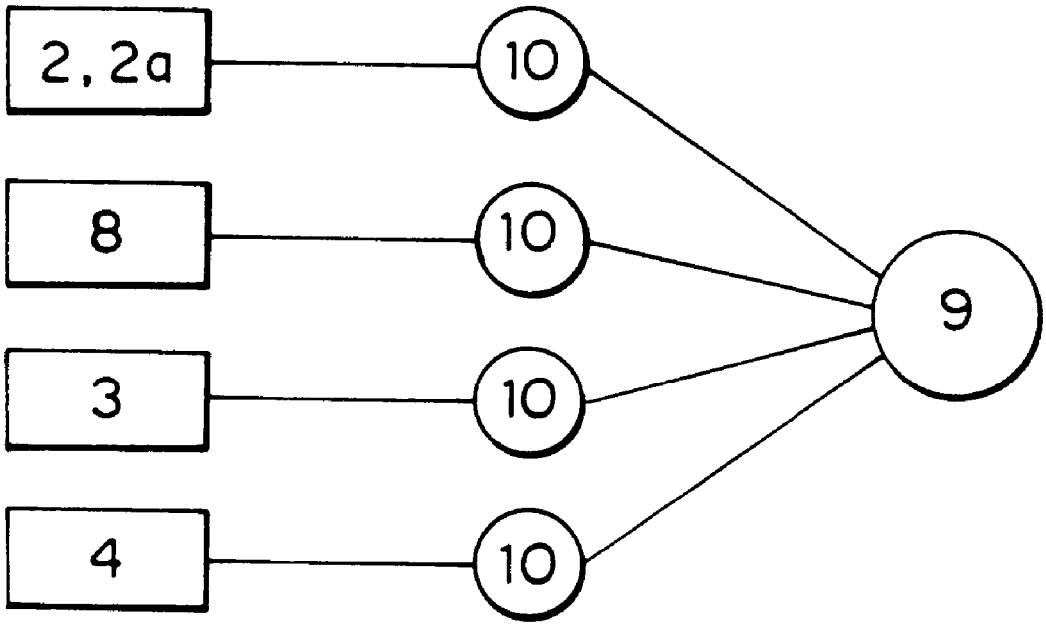
FIG. 3 is a diagram showing a system of operation of the individual members of the apparatus of the first embodiment.

In FIGS. 1 and 2, reference number 1 designates a needle bed for slidably receiving a multiplicity of parallel knitting needles (hereinafter called the needles) 2 longitudinally in and along the corresponding sliding grooves 1*a*; and 3, a monofilament guide constituting a monofilament bending means which is a characterized part of this invention. Reference number 4 designates a head-portion-holding member for holding a head portion from its inner side and positioning a bent position of the head portion during bending a monofilament 5; 6, a plurality of knitting yarns of a foundation structure of a fastener tape T; 6*a*, anchoring knitting yarns for securing a fastener element row 7; and 8, a number of knitting yarn guides for introducing the individual knitting yarns to the corresponding needles 2 and for forming stitches by swinging and shogging. The needle bed 1 and the needles 2 and the knitting yarn guide 8 are members which are ordinary components of this type Rachel machine and not peculiar to this invention. Actuating members for moving the needles 2 and the knitting yarn guides 8 are individually connected to a drive source 9, as shown in FIG. 3, for synchronous operation at a predetermined timing.

In the apparatus of the first embodiment, two needles 2*a* received in the second and third sliding grooves l*a*, 1*a* from one end of the needle bed 1 are anchoring needles for knitting the fastener element row 7 in the foundation structure of the fastener tape T, and the remaining needles 2 are needles for knitting the foundation structure of the fastener tape T. These needles 2, 2*a* are received in all the sliding grooves 1*a* of the needles bed 1 as mentioned above. In order to keep the monofilament guide 3 from interference with other actuating members and the knitting yarns, for example, every space between adjacent needles 2, 2*a* is set to be large enough for the monofilament guide 3 to pass therebetween. Therefore the stitch density might be coarse; for obtaining a desired stitch density, weft-inlaid yarns to be laid in the possible coarse portion may be, for example, of highly heat-contractible material.

Alternatively, instead of knitting all stitches in the same density, the space between the needles 2, 2*a* corresponding to the range of movement of the monofilament guide 3 may be enlarged as compared to the other inter-needle spaces. For example, the second and fifth sliding grooves 1*a* from one end of the needle bed 1 of FIG. 1 may be devoid of the needles 2 so as not to form stitches. In this case, two needles 2*a* received in the third and fourth sliding grooves between the second and fifth sliding grooves 1*a* are anchoring needles for knitting the fastener element row 7 in the foundation structure of the fastener tape T, and the remaining needles 2 are needles for knitting the foundation structure of the fastener tape T.

For lapping the knitting yarns 6, 6*a* over the individual needles 2, 2*a*, a multiplicity of knitting yarn guides 8 are disposed in front of the needle bed 1 to introduce the knitting yarns 6, 6*a* to the respective needles 2, 2*a*. These knitting guides 8 swings in a vertical direction between the individual needles 2, 2*a* so as to lap the knitting yarns 6, 6*a* in response to the respective back and forth movements determined according to the knitting patterns, and shogs in a transverse direction. By the lapping movements of the knitting yarn guides 8 and the back and forth movements of the needles 2, 2*a*, the knitting needles 6, 6*a* are introduced to the corresponding needles 2, 2*a* to form the respective stitches.

In FIG. 1, two sets of knitting yarn guides 8 are shown. Alternatively, for guiding various kinds of knitting yarns for knitting a woven structure, such as chain-stitch yarns, tricot-stitch yarns and weft-inlaid yarns, a corresponding number of sets of knitting yarn guides 8 may be used.

Further, in this embodiment, the monofilament guide 3, which is a main component of this invention, takes back-and-forth movements between one end of the needle bed 1 and a position off the front ends (the side toward you in FIG. 1) of the two needles 2, 2*a* received in the third and fourth sliding grooves 1*a*. As shown in FIG. 1, this monofilament guide 3 is in the form of a tube through which the monofilament 5 having a substantially oval cross section is inserted. The form of the monofilament 5 to be inserted through the monofilament guide 3 should not be limited to the illustrated embodiments, but may be a synthetic resin monofilament of a substantially circular cross section having longitudinally spaced successive flattened portions, which are previously formed by pressing to facilitate forming head portions 5*a* and connecting portions 5*c*.

The monofilament guide 3 is connected, together with other members, to a single drive source. According to this embodiment, the common drive source 9 as shown in FIG. 3 drives the individual members at a predetermined timing via the respective synchronous transmission mechanisms 10 such as rotary cams. Alternatively, the individual members may be driven independently of one another according to a program preset in a non-illustrated central control unit such as a computer.

The reciprocating movement of the monofilament guide 3 takes place at an underlapping position when at least the anchoring needles 2*a* are fully retracted, i.e. immediately after stitches are formed, thus bending the monofilament 5 to continuously form a coiled fastener element row 7. In this embodiment, in order to manufacture an ordinary type slide fastener stringer, the head portions 5*a* of the individual fastener elements of the fastener element row 7 are formed along the outermost edge of the fastener tape T. At that time, in order to maintain the bent shape of the monofilament 5 and the bent position of the head portion 5*a*, a tip of the hook-shaped head-portion-holding member 4 moves toward and away from the inner side of the head portion 5*a* of the monofilament 5 for holding the head portion 5*a* from its inner side. Since upper and lower legs portions 5*b* of the preceding fastener element are already anchored as knitted in the fastener tape at the time of bending the head portion 5*a*, it is unnecessary to positively define the bending position of the connecting portion 5*c*.

The process of manufacturing a knit slide fastener stringer on the apparatus of the first embodiment will now be described in detail based on the forming and knitting of the fastener element row 7 of FIGS. 1 and 2. In this process, for example, a knit slide fastener stringer having a warp-knit fastener tape shown in FIG. 4 is produced.

Figure 4:
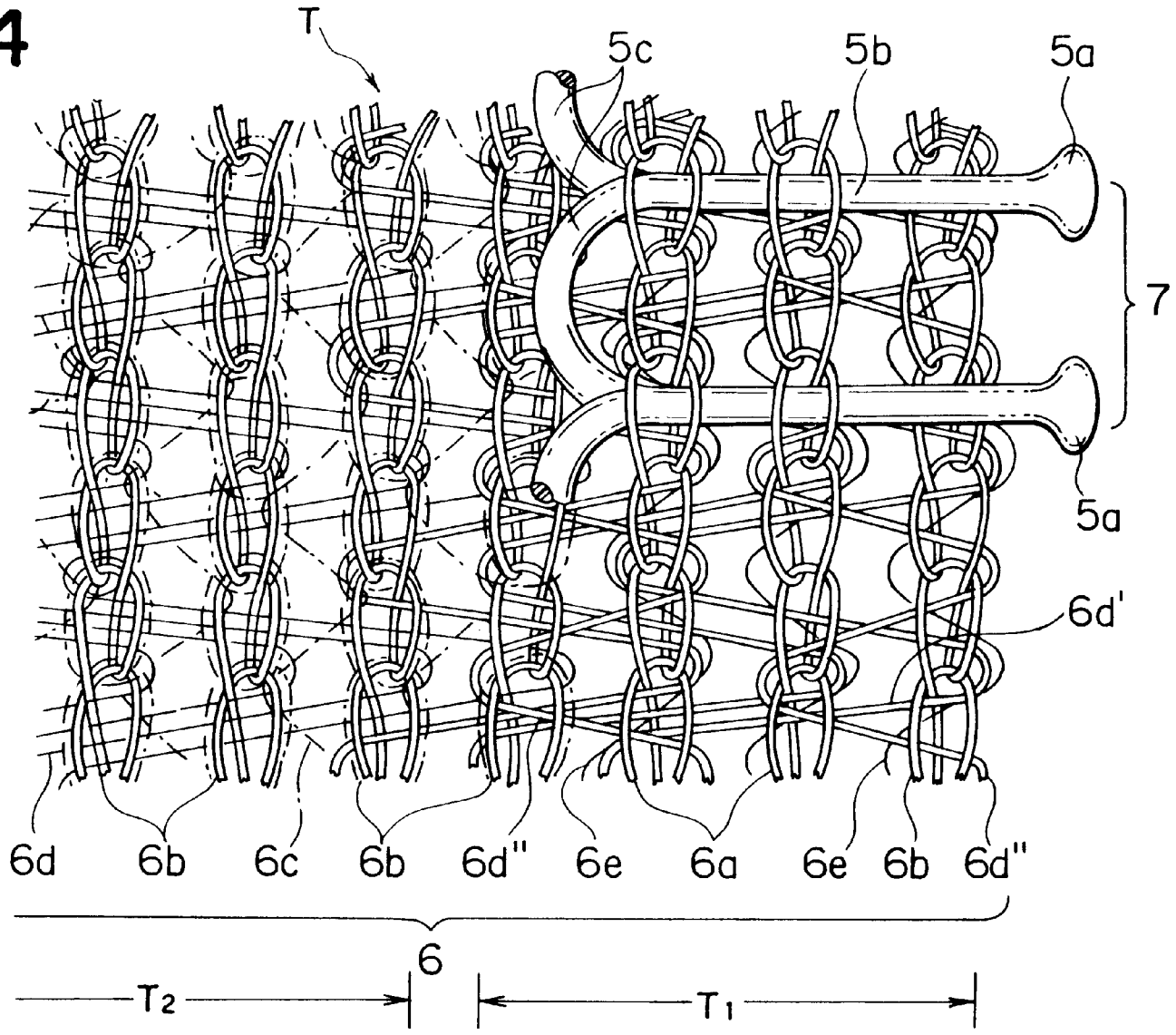
FIG. 4 is a fragmentary plan view schematically showing a knit structure of the knit slide fastener stringer that is knit on the apparatus of the first embodiment.

As shown in FIG. 4, the foundation structure of a web portion T2 of the fastener tape T is composed of chain-stitch yarns 6*b* forming a multiplicity of parallel longitudinal wales, tricot-stitch yarns 6*c* knit in the foundation structure each extending between adjacent wales, and weft-inlaid yarns 6*d* laid in a zigzag pattern in the foundation structure and each extending across four wales. Alternatively each weft-inlaid yarn 6*d* may extend in a zigzag pattern across three wales rather than four wales.

Outermost four wales of a side edge portion of the fastener tape T constitute a fastener-element attaching margin T1 whose knit structure is composed of chain-stitch yarns 6*a*, 6*b* forming these four wales, warp-inlaid yarns 6*e* extending in and along the outer three wales, and weft-inlaid yarns 6*d*′ laid in a zigzag pattern in the four-wale attaching margin T1 and each extending across three wales. In this embodiment, the weft-inlaid yarn 6*d*′ extends in a zigzag pattern across inner two wales of the four-wale attaching margin T1 and an outermost wale of the web portion T2 contiguous to the attaching margin T1. Further, in the four-wale attaching margin T1, two weft-inlaid yarns 6*d*" are laid in a zigzag pattern; the inner one extends across the inner two wales while the outer one extends across the outer two wales.

In this embodiment, the individual needles 2, 2*a* are spaced at uniform distances; if the knit slide fastener stringer is coarse in stitch density, it is preferable to use heat-contractible fibers of, for example, metamorphic polyester resin for the weft-inlaid yarns 6*d*, 6*d*', 6*d*". If the slide fastener stringer is knitted using an ordinary needle bed having a small inter-needle space, some of the sliding grooves 1*a* are preferably set to be devoid of the needles 2 to increase the inter-needle space. In this case, it is preferable that highly heat-contractible yarns are used for the weft-inlaid yarns 6*d* to be laid in the region in which the inter-needle space is set to be enlarged. The weft-inlaid yarns 6*d* are then shrunk by a thermal process after the fastener stringer is knitted, thus making the knit structure hight in density. However, when the locus of movement of the monofilament guide 3 is designed in such a manner that the guide 3 does not interfere with the knitting yarns and other members, all the sliding grooves 1*a* can have the needles 2, 2*a*, so that the weft-inlaid yarns 6*d* may not be heat-contractible in this case.

As is understood from FIG. 1, the individual fastener elements of the fastener element row 7 are knitted in every other courses. More specifically, the monofilament 5 is bent as the monofilament guide 3 actuates immediately after the foundation structure is knitted for one course. Then the anchoring needles 2*a* catch the succeeding needle loops of the anchoring chain-stitch yarns 6*a* over the upper surface of the fastener element. As this procedure is repeated, chain stitches are progressively formed longitudinally over the upper surface of the fastener element row 7. Regarding the web portion T2 of the fastener tape T, i.e. the whole fastener tape T except the attaching margin T1, all the needles 2, 2*a* are moved based on a preset knitting pattern to form a desired knit structure.

Further, adjacent wales of anchoring chain stitches may be connected by anchoring tricot stitches. The size and the number of the anchoring knitting yarns are decided according to the kind and application of the slide fastener and should not be limited. The stitches are shown in a loosened posture in FIG. 4 only for better understanding of the knit structure. So, the real stitches are much tighter.

As is understood from the foregoing knit structure, according to the apparatus of this embodiment, since the fastener elements are knitted in and anchored to the fastener tape T at stitches of every other courses, twice knitting are a single cycle for knitting the fastener elements 5. The movement of the individual member and its timing during this single-cycle knitting will now be described in detail with reference to FIGS. 1 and 2.

(1) With all the needles 2, 2*a* retracted, the monofilament guide 3 is moved along the previous stitches toward the head portion of the fastener element row 7 at the underlapping position of the anchoring needles 2*a*. At that time, in a position where the head portion 5*a* of the monofilament 5 arrives, a hook-shaped tip of the head-portion-holding member is waiting so that the monofilament 5 passes through the space between the head-portion-holding member 4 and the needle bed 1. This passing of the monofilament 5 brings an inner surface of the head-portion 5*a* to be bent against the hook-shaped tip of the head-portion-holding member 4 (FIG. 1).

(2) Then the monofilament guide 3 starts reversing to bend the head portion 5*a* of the monofilament 5 as it is caught by the hook-shaped tip of the head-portion-holding member 4, thus forming a single fastener element from the monofilament 5.

(3) When the monofilament guide 3 returns to a connecting portion 5*c* opposite to the head portion 5*a*, the individual needles 2, 2*a* moves forward so as to across over the newly formed upper and lower leg portions 5*b* of the fastener element. Upon arrival of the needles 2, 2*a* at the front limit thereof, the individual knitting yarn guides 8 take swinging movement and shogging movement to overlap the individual knitting yarns 6 to the corresponding needles 2. During this time, the monofilament guide 3 moves slightly upwardly off the connecting portion 5*c* and waits there so as not to interfere with other members and the knitting yarns (FIG. 2).

(4) Upon termination of this overlapping of the individual knitting yarns 6, the individual needles 2, 2*a* moves backward to form the stitches of a single course of the attaching margin T1 and the web portion T2 of the fastener tape T. Namely, in the attaching margin T1, the needle loops of two anchoring chain-stitch yarns 6*a* extend over the newly formed upper and lower leg portions 5*b* of the fastener element so as to be tightened and fixed by their sinker loops, the weft-inlaid yarns 6*d*', 6*d*" and the warp-inlaid yarns 6*e*. In the web portion T2, the above-mentioned knit structure is formed. At that time, the individual knitting yarn guides 8 having taken overlapping movement stops at the overlapping position.

(5) Subsequently, when the head-portion-holding member 4 is retracted to such a position as not to interfere with other members, the individual needles 2, 2*a* moves forward again, whereupon the individual knitting yarn guides 8 take overlapping movement to overlap the knitting yarns 6 to the corresponding needles 2, 2*a*. Upon termination of this overlapping, the individual needles 2, 2*a* is retracted to terminate knitting for a single course of the attaching margin T1 and the web portion T2 of the fastener tape T.

(6) During that time, the monofilament guide 3 temporarily stay in the standby position above the individual needles 2, 2*a* or reciprocates between that standby position and a position above the connecting portion 5*c* opposite to the head portion 5*a*.

This reciprocating movement of the monofilament guide 3 does not serve to bend the monofilament 5 but merely as to avoid interference with other members.

The foregoing procedures (1)–(6), which is a single cycle of operation, are then repeated to knit the continuous coiled fastener element row 7 in the attaching margin T1 of the fastener tape T simultaneously with the knitting of the fastener tape T while the monofilament 5 is intermittently bent to form the coiled fastener elements.

Figure 5:
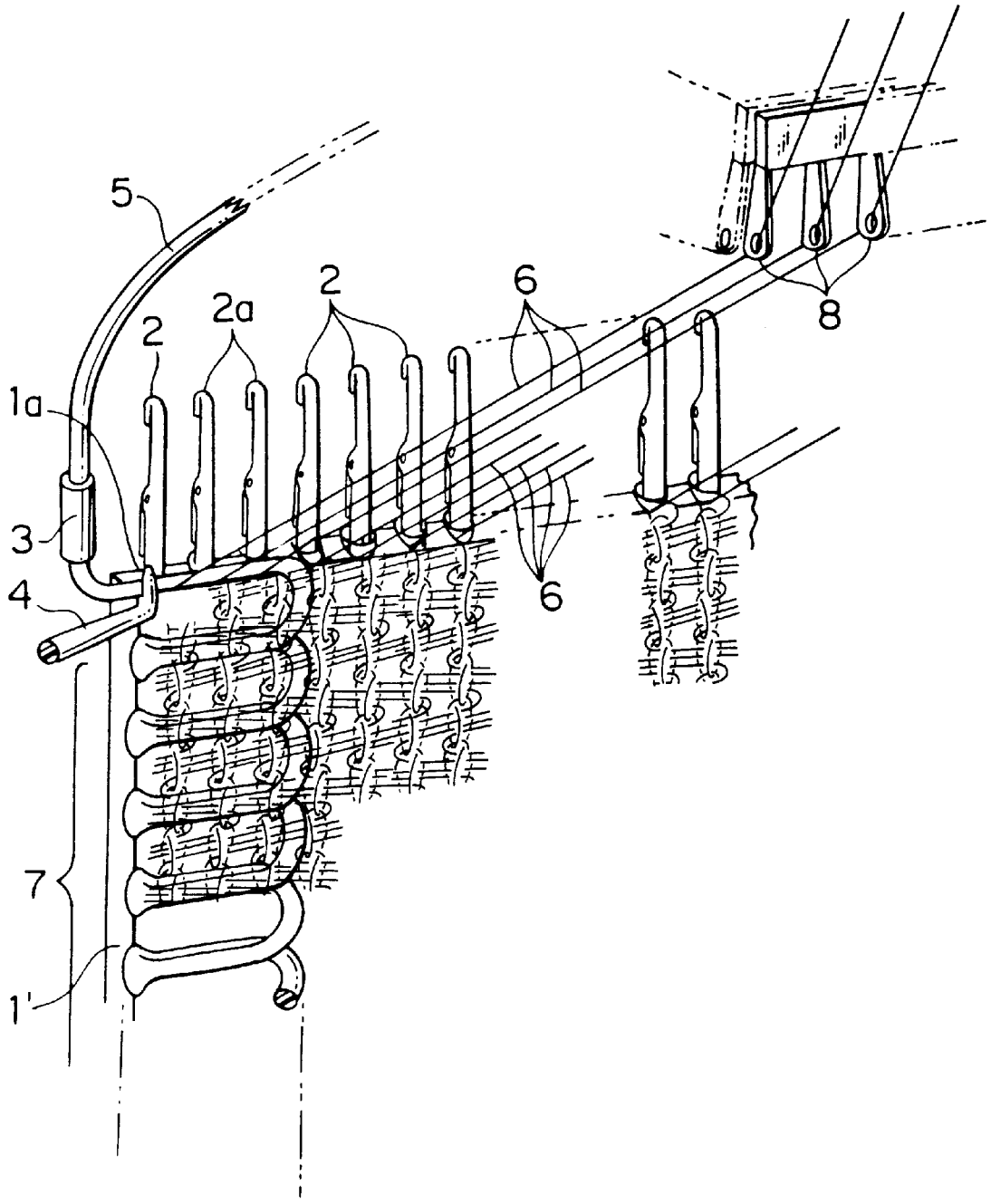
FIG. 5 shows various members of a knit slide fastener stringer manufacturing apparatus during bending of a monofilament according to a second embodiment of the invention.
Figure 6:
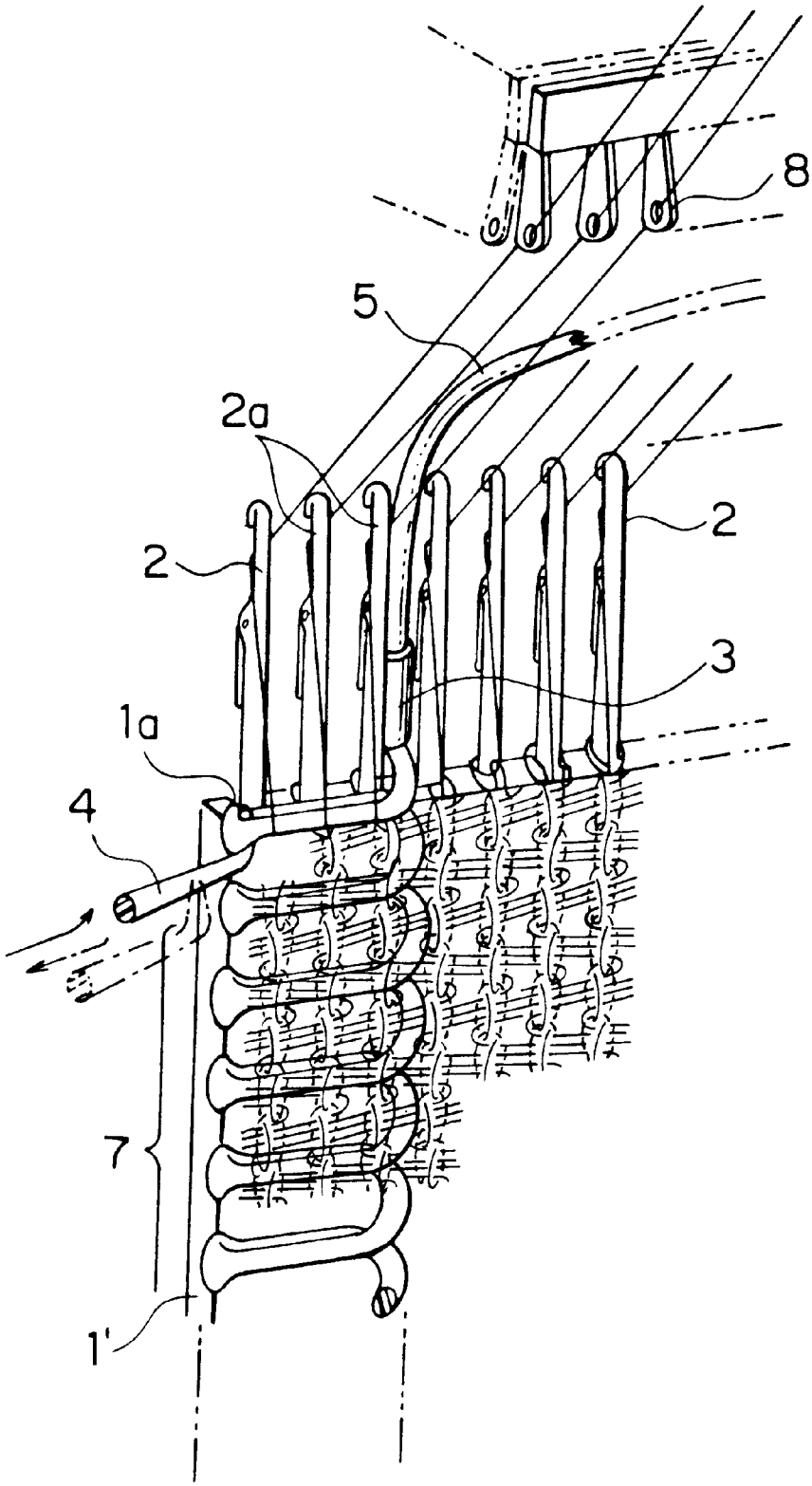
FIG. 6 shows the members of the apparatus of the second embodiment during overlapping of knitting yarns.

FIGS. 5 and 6 show a second embodiment of the invention. The second embodiment is identical with the first embodiment except that a single Raschel knitting machine is used in which a needle bed 1' extends vertically so that all the needles 2 are moved vertically in the corresponding sliding grooves of the needle bed 1'. Thus the remaining members of the second embodiment are substantially similar in arrangement and movement to those of the first embodiment. However, the timing of movement of the individual members of this embodiment is different from that of the first embodiment. The main knitting operation is as follows:

(1) When all the needles 2, 2*a* start moving upwardly, the monofilament guide 3 along the previous stitches toward the head portion of the fastener element row 7 at the underlapping position of the anchoring needles 2*a*. At that time, a hook-shaped tip of the head-portion-holding member 4 is waiting at a position where of the head portion 5*a* of the monofilament 5 arrives, and then the monofilament 5 is inserted through the space between the head-portion-holding member 4 and the needle bed 1'. This inserting of the monofilament 5 brings an inner surface of the head portion 5*a* to be bent against the hook-shaped tip of the head-portion-holding member 4 (FIG. 5).

(2) Upon arrival at the turning position beyond the head portion 5*a*, the monofilament guide 3 starts reversing so that the head portion 5*a* is bent as caught by the hook-shaped tip of the head-portion-holding member 4. Thus a single fastener element is formed from the monofilament 5. At that time, the individual needles 2, 2*a* arrive at the uppermost positions. When the monofilament guide 3 is returned to the connecting portion 5*c* opposite to the head portion 5*a* and is moved slightly toward the needle bed 1', the bent monofilament 5 is pressed against the previous stitches to stabilize its bent shape.

(3) When the monofilament guide 3 is stopped, the individual knitting yarn guides 8 starts swinging and shogging to overlap the individual knitting yarns to the corresponding needles 2 (FIG. 6). During that time, the monofilament guide 3 moves slightly upwardly off the connecting portion 5*c* and waits there so as not to interfere with other members and the knitting yarns (FIG. 6).

(4) Upon termination of overlapping of the individual knitting yarns 6, the individual needles 2, 2*a* are lowered to form the respective stitches of a single course of the attaching margin T1 and the web portion T2 of the fastener tape T. Namely, in the attaching margin T1, the needle loops of two anchoring chain-stitch yarns 6*a* extend tightened over the upper and lower leg portions 5*b* of the fastener element so as to be tightened and fixed by their sinker loops, the weft-inlaid yarns 6*d*, etc. In the web portion T2, the above-mentioned knit structure is formed. At that time, the individual knitting yarn guides 8 having taken overlapping movement stops at the overlapping position.

(5) Subsequently, when the head-portion-holding member 4 is retracted to such a position as not to interfere with other members, the individual needles 2, 2*a* starts moving upward again, at which time the monofilament guide 3 stays at the above-mentioned waiting position that is slightly upwardly off the connecting portion 5*c*. When the individual needles 2, 2*a* arrive at the uppermost positions, the corresponding knitting yarn guides 8 take overlapping movement to overlap the knitting yarns 6 to the corresponding needles 2. Upon termination of this overlapping, the individual needles 2, 2*a* move backward to terminate knitting a single course of the attaching margin T1 and the web portion T2 of the fastener tape T without knitting any fastener element in the fastener tape T.

As is understood from the foregoing description of movement of the individual members, in the apparatus of this embodiment, partly since the timing of operation of the monofilament guide 3 is such that the monofilament guide 3 operates at such a position as not to interfere with other members and partly since the position of stopping of the monofilament guide 3 is retracted to such a position as not to interfere with other members and the knitting yarns, smooth knitting can be achieved with no obstruction.

In the second embodiment, the individual needles are received one in each of the sliding grooves 1*a* of the needle bed 1'. Alternatively, the second and fifth sliding grooves 1*a* of the needle bed 1' may be devoid of the needles in order to avoid interference of the monofilament guide 3 with other members of the knitting yarns during its turning and stopping.

Figure 7:
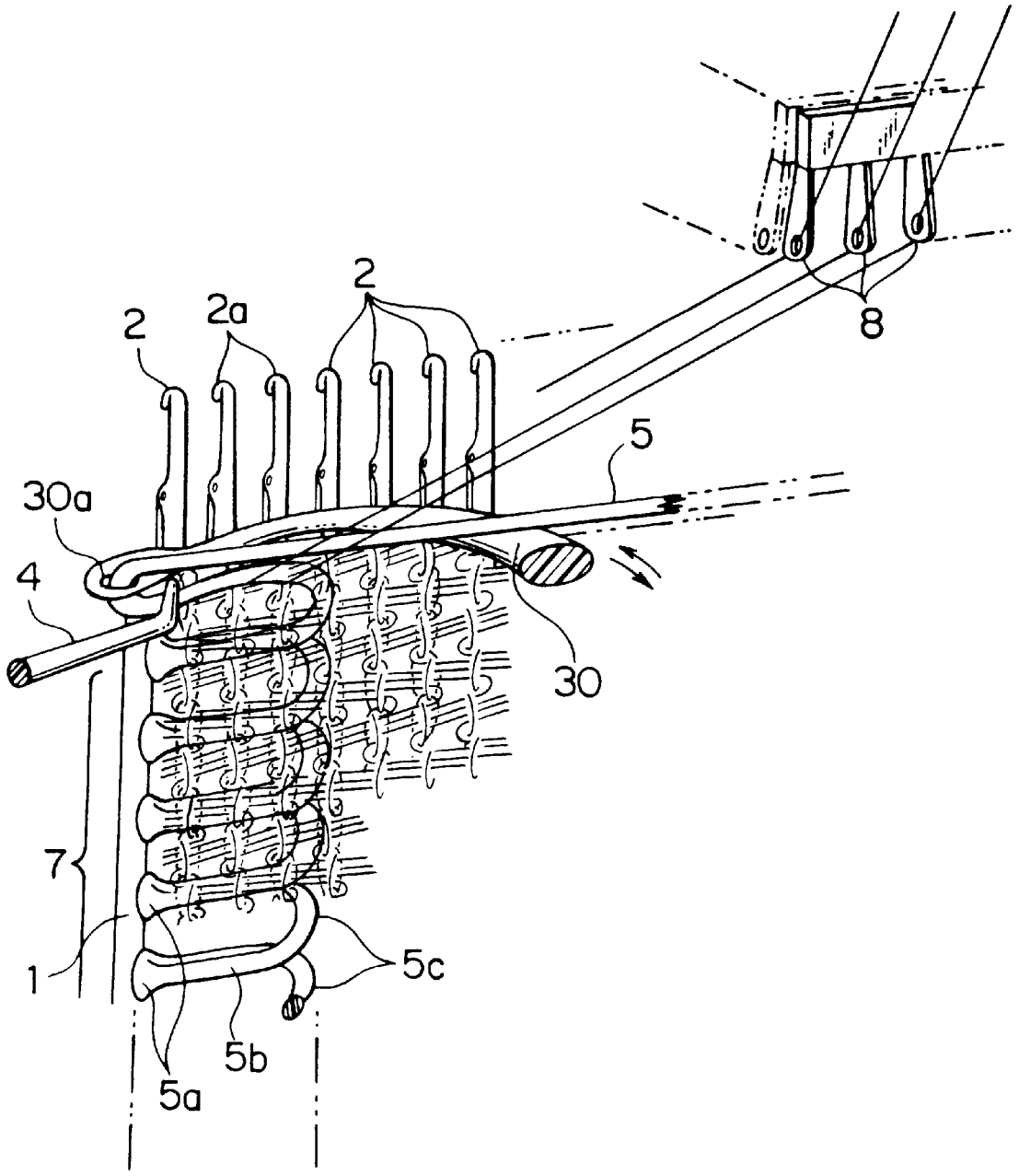
FIG. 7 is a view, but showing various members of a knit slide fastener stringer manufacturing apparatus during bending of a monofilament according to a third embodiment.

FIG. 7 shows a third embodiment of the invention. This embodiment is identical with the second embodiment except that a monofilament bending means is in the form of a substantially bow-shaped pivotal lever 30. The pivotal lever 30 is connected at its base end to a non-illustrated pivotal mechanism and has in its free end a monofilament-insertion hole 30*a* through which a monofilament 5 is inserted. The pivotal lever 30 operates at the same timing as that in the second embodiment to reciprocate at the underlapping position of the upwardly moving three needles 2, 2*a*, thus forming the individual fastener elements of the fastener element row 7 successively by bending the monofilament 5. In this embodiment, since it has the same form as a weft yarn carrier of an ordinary narrow-width loom, the bow-shaped pivotal member 30 is easy to be inserted through the space between the needles 2, 2*a* and the knitting yarns and hence tends to be kept from interference with other members.

Figure 8:
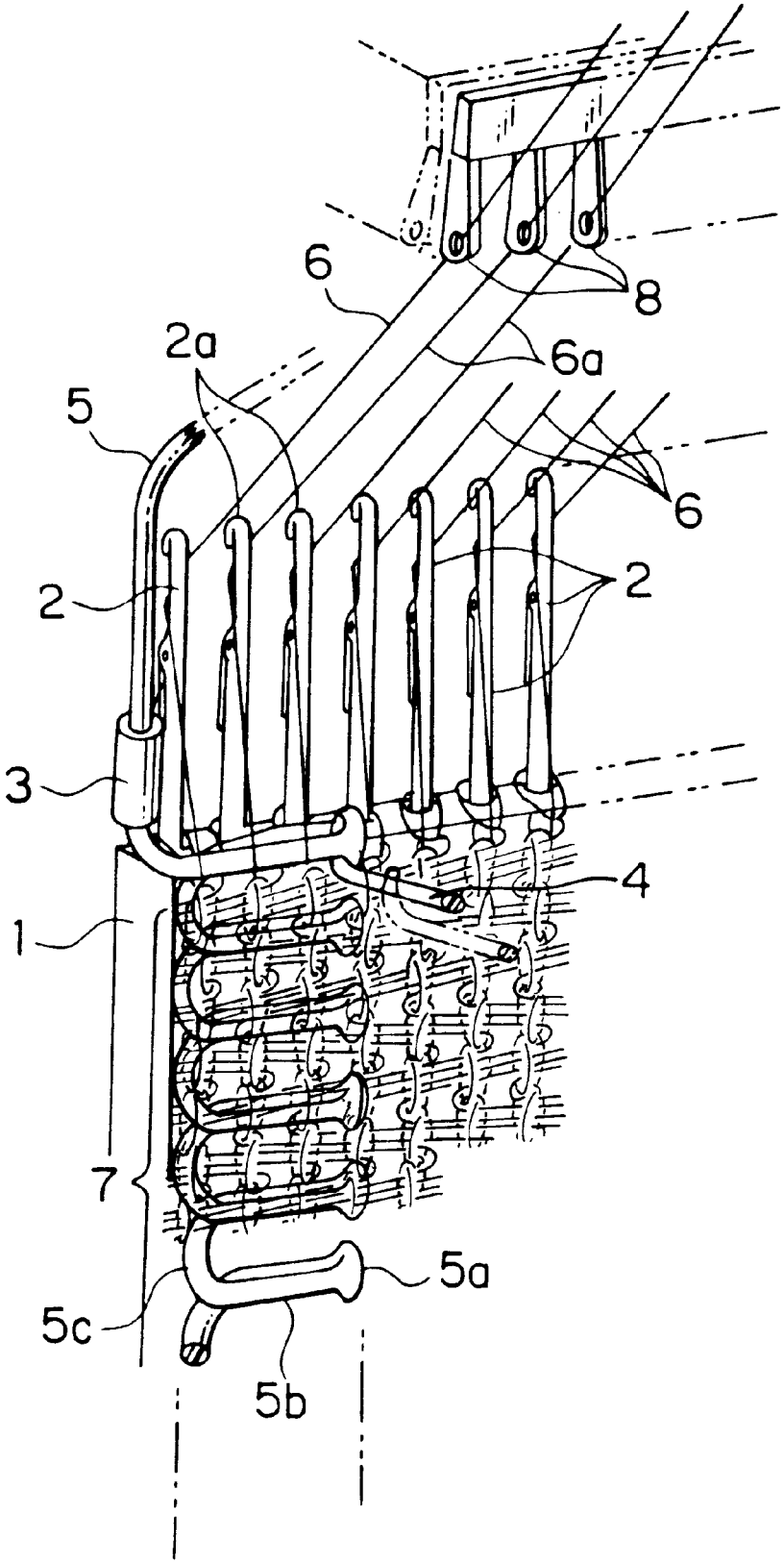
FIG. 8 is a view showing various members of a knit slide fastener stringer manufacturing apparatus during bending of a monofilament according to a fourth embodiment of this invention.

FIG. 8 shows a fourth embodiment of the invention. This embodiment is identical with the second embodiment except that the head-portion-holding member 4 is disposed at a side of the fastener-element attaching margin T1 of the fastener tape T toward the web portion T2, and moves between a holding position for holding a center of the head portion 5*a* from an inner side thereof and a non-holding position. With the standby position which is slightly off the outermost end of the needle bed 1, the monofilament guide 3, which serves as the monofilament bending means, takes a return trip turning round the head-portion-holding member 4. Therefore, according to this embodiment, since the head portions 5*a* of the fastener element row 7 are formed along the attaching portion T1 at the side toward the web portion T2, the thus knitted slide fastener stringer is heat-set, as it is folded along the head portions 5*a* with the head portions 5*a* facing outside, to stabilize the shape. As a result, a so-called concealed slide fastener stringer is obtained.

In the foregoing embodiments, the fastener element row knitted in the fastener tape is a coiled type. Alternatively, the fastener element row may be a zigzag type, in which upper and lower horizontal U-shape bents are successively and alternately arranged along the fastener tape T. The coiled fastener element row can be obtained by changing the timing of operation between the reciprocating movement of the monofilament bending means and the head-portion-holding movement of the head-portion-holding member.

Various other changes and modifications may be suggested regarding, for example, the shape and driving mode of the monofilament bending means and the head-portion-holding member, the knit structure of the foundation structure and the anchoring knit structure.

As is apparent from the foregoing description, according to the method and apparatus of this invention, by adding a slight improvement to, for example, the conventional single Raschel knitting machine, it is possible to efficiently manufacture a knit slide fastener stringer having a desired knit structure with a fastener element row 7 knitted therein. Further, by retracting the return locus of the monofilament bending means, which constitutes a characterizing feature of the invention, to such a position as not to interfere with other knitting members and the knitting yarns, it is possible to bend the monofilament accurately at a desired timing and in a stable shape.

Furthermore, if the head-portion-holding member for holding a free end of the bent, which is to be a head portion, of the monofilament from its inner side during bending, is provided in addition to the monofilament bending means, it is possible to secure a stable shape of the individual fastener elements and to position the head portions of the fastener element row accurately.

What is claimed is:

1. A method of manufacturing a knit slide fastener stringer having a slide fastener element row which is continuously knitted in and along one longitudinal edge of a warp-knit fastener tape simultaneously with the knitting of the fastener tape while the slide fastener element row is formed by bending a linear synthetic resin monofilament, said method comprises the steps of:

(a) sliding a predetermined number of knitting needles along a multiplicity of parallel sliding grooves in a single needle bed at a predetermined timing;

(b) swinging and shogging a number of knitting yarn guides in timed relation with said sliding of said knitting needles to form desired stitches; and (c) driving monofilament bending means, which is disposed between said needle bed and said knitting yarn guides at a position near one end of said needle bed, in synchronism with the movement of said knitting needles and said knitting yarn guides, wherein said monofilament bending means reciprocates along a predetermined number of said knitting needles, which is less than a total number of said knitting needles, at an underlapping position to continuously form individual slide fastener elements by bending the monofilament and also to knit the slide fastener elements in the fastener tape simultaneously with the knitting of the fastener tape.

2. A method according to claim 1, wherein a single reciprocating movement of said monofilament bending means takes place immediately after the stitches of the fastener tape are formed.

3. A method according to claim 2, wherein the single reciprocating movement of said monofilament bending means takes place immediately after the stitches of the fastener tape are formed at each of every other courses.

4. A method according to any of claims 1–3, further including a step of moving a head-portion-holding member between a holding position for holding a head portion of each fastener element and a non-holding position, in synchronism with the bending of the monofilament.

5. A method according to claim 4, wherein said head-portion-holding position is disposed at an outer end portion of said needle bed, while a terminal position, where said monofilament bending means is retracted so as not to interfere with the knitting yarns, of said single reciprocating movement of said monofilament bending means is disposed at a position inside said one end of said needle bed.

6. A method according to claim 4, wherein said head-portion-holding position is disposed at a position inside said one end of said needle bed, while a terminal position of said single reciprocating movement of said monofilament bending means is disposed at an outer end portion of said needle bed.

7. An apparatus for manufacturing a knit slide fastener stringer having a slide fastener element row which is continuously knitted in and along one longitudinal edge of a warp-knit fastener tape simultaneously with the knitting of the warp-knit fastener tape while the slide fastener element row is formed by bending a linear synthetic resin monofilament, said apparatus comprising:

(a) a single needle bed slidably guiding a multiplicity of parallel knitting needles;

(b) a number of knitting yarn guides moveable relative to the knitting needles;

(c) a monofilament bender disposed between said needle bed and said knitting yarn guides at a position near one end of said needle bed; and (d) a driver connected to and synchronously driving said knitting needles, said knitting yarn guides and said monofilament bender at a predetermined timing, wherein said monofilament bender is moved along a predetermined number of said knitting needles, which is less than a total number of said knitting needles, at an underlapping position to continuously form individual slide fastener elements by bending the monofilament and also to knit the slide fastener elements in the fastener tape simultaneously with the knitting of the fastener tape.

8. An apparatus according to claim 7, further including a head-portion-holding member moveable between a holding position for holding a head portion of each slide fastener element and a non-holding position in synchronism with the bending of the monofilament.

9. An apparatus according to claim 8, wherein said head-portion-holding member is disposed at an outer end portion of said needle bed, while a terminal position, where said monofilament bender is retracted so as not to interfere with the knitting yarns, of said single reciprocating movement of said monofilament bender is disposed at a position inside said one end of said needle bed.

10. An apparatus according to claim 8, wherein said head-portion-holding member is disposed at a position inside said one end of said needle bed.

11. An apparatus according to any of claims 7–8, wherein said needle bed is disposed so as to extend substantially horizontally.

12. An apparatus according to any of claims 7–8, wherein said needle bed is disposed so as to extend substantially vertically.

* * * * *